US010204577B2

(12) United States Patent
Deng et al.

(10) Patent No.: US 10,204,577 B2
(45) Date of Patent: Feb. 12, 2019

(54) DRIVING METHOD, DRIVING CIRCUIT AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Liguang Deng, Beijing (CN); Zhen Chen, Beijing (CN); Hyungkyu Kim, Beijing (CN); Moyu Zhu, Beijing (CN); Yingming Liu, Beijing (CN); Jun Cheng, Beijing (CN); Ming Zhai, Beijing (CN)

(73) Assignees: BOE TECHNOLOGY GROUP CO. LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 134 days.

(21) Appl. No.: 15/125,909

(22) PCT Filed: Aug. 14, 2015

(86) PCT No.: PCT/CN2015/087007
§ 371 (c)(1),
(2) Date: Sep. 13, 2016

(87) PCT Pub. No.: WO2016/090944
PCT Pub. Date: Jun. 16, 2016

(65) Prior Publication Data

US 2017/0004792 A1 Jan. 5, 2017

(30) Foreign Application Priority Data

Dec. 8, 2014 (CN) ..... 2014 1 0743811

(51) Int. Cl.
*G09G 3/36* (2006.01)

(52) U.S. Cl.
CPC ..... *G09G 3/3648* (2013.01); *G09G 3/3614* (2013.01); *G09G 3/3677* (2013.01);
(Continued)

(58) Field of Classification Search
CPC ..... G09G 3/3614
See application file for complete search history.

(56) References Cited

U.S. PATENT DOCUMENTS 6,549,187 B1 * 4/2003 Matsubara ..... G09G 3/3614 345/100
2003/0112386 A1 * 6/2003 Bu ..... G09G 3/3611 349/96

(Continued)

FOREIGN PATENT DOCUMENTS

CN 1601597 A 3/2005
CN 102376274 A 3/2012

(Continued)

OTHER PUBLICATIONS

The World Intellectual Property Organization (WIPO) International Search Report for PCT/CN2015/087007 dated Nov. 11, 2015 p. 1-4.

(Continued)

*Primary Examiner* — Vijay Shankar
*Assistant Examiner* — Cory A Almeida
(74) *Attorney, Agent, or Firm* — Anova Law Group, PLLC

(57) ABSTRACT

A driving method is provided to drive an LCD panel having rows of pixels includes obtaining source data signals of a plurality of frames for the LCD panel; inputting a source data signal of one frame of the plurality of frames; and inverting polarity of the source data signal of the one frame before scanning sequentially the rows of pixels. The driving (Continued)

method also includes configuring at least one of timing of the source data signal and timing of scanning a first row of the rows of pixels to cause a time overlap between an actual scanning time of the first row and a time period when the source data signal is at a threshold value to be no less than an original scanning time of the first row; scanning the first row of the rows of pixels; and scanning rest of the rows of pixels to complete displaying the one frame.

15 Claims, 4 Drawing Sheets

(52) U.S. Cl.
CPC ... *G09G 3/3688* (2013.01); *G09G 2300/0452* (2013.01); *G09G 2300/0823* (2013.01); *G09G 2310/08* (2013.01); *G09G 2320/0233* (2013.01)

(56) References Cited

U.S. PATENT DOCUMENTS

| | | | |
|---|---|---|---|
| 2008/0001902 | A1 | 1/2008 | Kim |
| 2011/0221727 | A1 | 9/2011 | Kim et al. |

FOREIGN PATENT DOCUMENTS

| | | | |
|---|---|---|---|
| CN | 103985365 | A | 8/2014 |
| CN | 104361876 | A | 2/2015 |
| JP | 2003207760 | A | 7/2003 |

OTHER PUBLICATIONS

The State Intellectual Property Office of the People's Republic of China (SIPO) Office Action 2 for 20140743811.0 dated May 30, 2016 p. 1-8.

* cited by examiner

DRIVING METHOD, DRIVING CIRCUIT AND DISPLAY APPARATUS

CROSS-REFERENCES TO RELATED APPLICATIONS

This application is a national phase entry under 35 U.S.C. § 371 of International Application No. PCT/CN2015/087007, filed on Aug. 14, 2015, which claims priority of Chinese Patent Application No. 201410743811.0, filed on Dec. 8, 2014. The above enumerated patent applications are incorporated by reference herein in their entirety.

FIELD OF THE INVENTION

The present invention generally relates to the field of display technologies and, more particularly, to display panel driving methods and driving circuits and display apparatuses.

BACKGROUND

Because of its small size, low power consumption, no radiation, and other characteristics, liquid crystal display (LCD) has become a mainstream product in today's flat panel display market. The LCD panel is a key component of an LCD device.

To avoid liquid crystal fatigue from happening during the display operation of an LCD panel, polarity inversion, such as the column inversion or frame inversion, is generally applied during the display operation of the LCD panel. Currently, in order to achieve better picture display quality for the LCD panel, the resolution of the LCD panel is becoming higher and higher. However, the frame rate of the mainstream LCD products still remains at around 60 Hz, which generates a large panel load for the LCD panel with such frame rate when operating in the column/frame inversion mode.

As illustrated in FIG. 1 and FIG. 2, when the LCD panel operates in the column/frame inversion mode, due to the panel load, it requires a rise time and a fall time for a source data signal to reach a preset value P during a positive and negative polarity inversion of the source data signal. For a total of n rows of pixels/pixels (G1-Gn) to be scanned, the source data signal S1 is inversed when or shortly before the first row of pixels is scanned. Thus, it often causes a shorter charging time for the first-row of pixels than the pixels of the rest n-1 rows after the polarity inversion, i.e., T1<Tn. In the case of a relatively high resolution, it can lead to insufficient charging for the first-row of pixels 4 after the polarity inversion, creating a bad bright line or dark line display (as shown in FIG. 2) for the first-row of pixels 4. In addition, at low temperatures, the decreasing of switching-on current (Ion) in the thin film transistor (TFT) in the LCD panel makes the charging of the first-row of pixels 4 further insufficient, worsening the display quality.

The disclosed method and system are directed to at least partially alleviate one or more problems set forth above and other problems.

BRIEF SUMMARY OF THE DISCLOSURE

One aspect of the present disclosure provides a driving method to drive an LCD panel having rows of pixels. The driving method includes obtaining source data signals of a plurality of frames for the LCD panel; inputting a source data signal of one frame of the plurality of frames; and inverting polarity of the source data signal of the one frame before scanning sequentially the rows of pixels. The driving method also includes configuring at least one of timing of the source data signal and timing of scanning a first row of the rows of pixels to cause a time overlap between an actual scanning time of the first row and a time period when the source data signal is at a threshold value to be no less than an original scanning time of the first row, wherein the original scanning time of the first row is an average scanning time of a single-row of pixels in the rows of pixels for the one frame; scanning the first row of the rows of pixels; and scanning rest of the rows of pixels to complete displaying the one frame.

Optionally, configuring at least one of timing of the source data signal and timing of scanning a first row of the rows of pixels includes starting scanning the first row of pixels when the source data signal reaches the threshold value.

Optionally, configuring at least one of timing of the source data signal and timing of scanning a first row of the rows of pixels includes starting scanning the first row of pixels after a time period of approximately the original scanning time of the first row from when the source data signal is inversed.

Optionally, configuring at least one of timing of the source data signal and timing of scanning a first row of the rows of pixels and scanning the first row of pixels includes scanning the first row of pixels twice, each by the original scanning time, starting from when the source data signal is inversed.

Optionally, configuring at least one of timing of the source data signal and timing of scanning a first row of the rows of pixels and scanning the first row of pixels includes scanning the first row of pixels by twice of the original scanning time, starting from when the source data signal is inversed.

Optionally, the source data signal reaches the threshold value during a first time scanning of the first row of pixels.

Optionally, the LCD panel is displayed in one of a column inversion mode and a frame inversion mode.

Another aspect of the present disclosure provides a driving circuit. The driving circuit includes a first latch and trigger unit, a second latch and trigger unit, and a select unit. The first latch and trigger unit is configured to latch and output a source data signal of frame line by line for the display of an LCD panel having a plurality of rows of pixels. The second latch and trigger unit is configured to latch and output the source data signal from the first latch and trigger unit. Further, the select unit is configured to selectively output one of output signals from the first latch and trigger unit and the second latch and trigger unit.

Optionally, an input terminal of the second latch and trigger unit is coupled to the output terminal of the first latch and trigger unit; input terminals of the select unit are respectively coupled to the output terminal of the first latch and trigger unit and the output terminal of the second latch and trigger unit to select between the output signal of the first latch and trigger unit and the output signal of the second latch and trigger unit; and the output terminal of the first latch and trigger unit is coupled to a first input terminal of the select unit, and the output terminal of the second latch and trigger unit is coupled to a second input terminal of the select unit.

Optionally, the first latch and trigger unit further includes a first trigger module; and a first input terminal of the first trigger module is configured to input the source data signal for display line by line.

Optionally, the first latch and trigger unit further includes a first latch module and a second trigger module; and an output terminal of the first trigger module is coupled to an input terminal of the first latch module, an output terminal of the first latch module is coupled to a first input terminal of the second trigger module, an output terminal of the second trigger module is coupled to an input terminal of the second latch module, and an output terminal of the second latch module is coupled to a first input terminal of the third trigger module.

Optionally, the second latch and trigger unit includes a second latch module and a third trigger module; a second input terminal of the first trigger module, a second input terminal of the second trigger module, and a second input terminal of the third trigger module are configured to input respectively a same trigger control signal; and the trigger control signal is configured to trigger the first trigger module, the second trigger module and the third trigger module to output respectively the source signal from the respective first input terminals of the first trigger module, second trigger module and third trigger module.

Optionally, the select unit includes a select module; a first input terminal of the select module is coupled to the output terminal of the third trigger module, and a second input terminal of the select module is coupled to the output terminal of the first latch module; and a select input of the select module is configured to input a selection trigger signal for the select module to select and output the source data signal from the second input of the select module.

Optionally, the selection trigger signal is inputted at the beginning of displaying each frame.

Optionally, the trigger control signal is inputted when each row source data signal is inputted; and the trigger control signal includes a data synchronization signal and a data output enable signal.

Another aspect of the present disclosure provides a display apparatus. The display apparatus includes the above-described driving circuit.

Other aspects of the present disclosure can be understood by those skilled in the art in light of the description, the claims, and the drawings of the present disclosure.

DETAILED DESCRIPTION

In order for those skilled in the art to better understand the technical solutions of the present invention, the followings together with accompanying drawings describe in detail the present invention with specific embodiments. Wherever possible, the same reference numbers will be used throughout the drawings to refer to the same or like parts.

Figure 8:
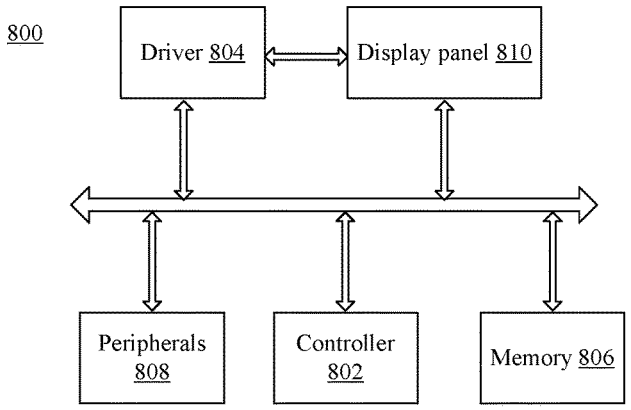
FIG. 8 illustrates a block diagram of an exemplary display apparatus according to the disclosed embodiments.

FIG. 8 illustrates an exemplary display apparatus 800 incorporating certain disclosed embodiments. The display apparatus 800 may be any appropriate device or component with certain display functions, such as an LCD panel, an LCD TV, a monitor, a cell phone or smartphone, a computer, a tablet, or a navigation system, or any products or components with liquid crystal display function, etc. As shown in FIG. 8, the display apparatus 800 includes a controller 802, a driving circuit 804, memory 806, peripherals 808, and a display panel 810.

The controller 802 may include any appropriate processor or processors, such as a general-purpose microprocessor, digital signal processor, and/or graphic processor. Further, the controller 802 can include multiple cores for multi-thread or parallel processing. The memory 806 may include any appropriate memory modules, such as read-only memory (ROM), random access memory (RAM), flash memory modules, and erasable and rewritable memory, and other storage media such as CD-ROM, U-disk, and hard disk, etc. The memory 806 may store computer programs for implementing various processes, when executed by the controller 802.

Peripherals 808 may include any interface devices for providing various signal interfaces, such as USB, HDMI, VGA, DVI, etc. Further, peripherals 808 may include any input and output (I/O) devices, such as keyboard, mouse, and/or remote controller devices. Peripherals 808 may also include any appropriate communication module for establishing connections through wired or wireless communication networks.

The driving circuit 804 may include any appropriate driving circuits to drive the display panel 810. The display panel 810 may include any appropriate flat panel display, such as an LCD panel, an LED-LCD panel, a plasma panel, an OLED panel, etc. During operation, the display 810 may be provided with image signals or other source data signals by the controller 802 and the driving circuit 804 for display.

In certain embodiments, display panel 810 may include an LCD panel, such as a thin-film-transistor (TFT) LCD panel. The LCD panel may include a first or a front substrate, a second or a rear substrate, and liquid crystal filled between the substrates. The first substrate may be a color-filter substrate for forming a color-filter film and the second substrate may be an array substrate for forming an active matrix, e.g., a TFT array.

In operation, the driving circuit 804 may be configured to improve the bad bright line or dark line display of the first-row of pixels or sub-pixels appeared at the beginning of displaying each frame after the polarity inversion of the source data signal, thereby enhancing the display effect of the display apparatus 800.

Figure 7:
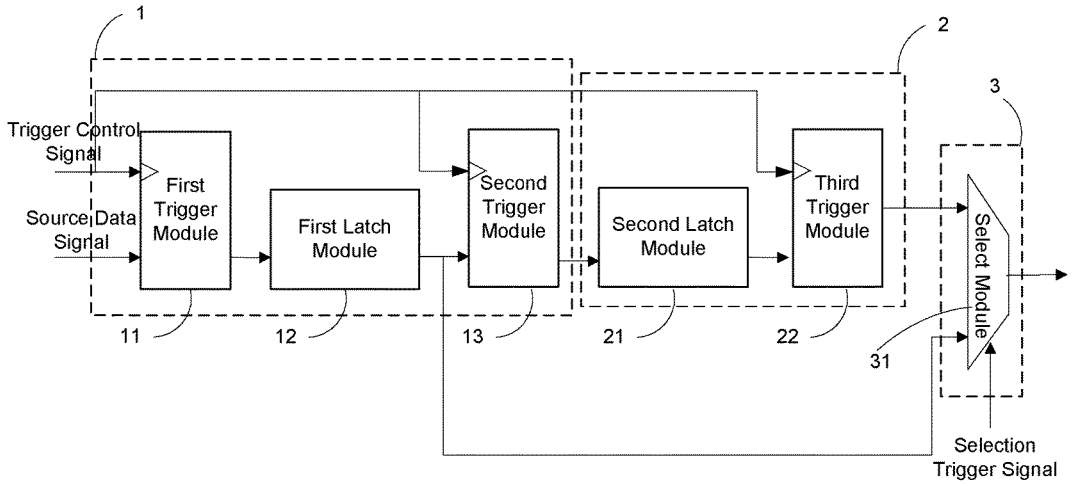
FIG. 7 illustrates a circuit block diagram of an exemplary driving circuit according to the disclosed embodiments.

A pixel may refer to a basic display element from a display panel. When displaying color images, a pixel may also refer to a combination of several sub-pixels of different colors, such as red, blue, green, etc. Thus, unless stated explicitly, pixel and sub-pixel may be used interchangeably. FIG. 7 illustrates a circuit block diagram of an exemplary driving circuit 804 according to the disclosed embodiments.

As shown in FIG. 7, the driving circuit includes a first latch and trigger unit 1, a second latch and trigger unit 2, and a select unit 3.

The first latch and trigger unit 1 may be configured to latch and output a source data signal, line by line, for the display of an LCD panel. The input terminal of the second latch and trigger unit 2 is connected or coupled to the output terminal of the first latch and trigger unit 1, and the two input terminals of the select unit 3 are connected respectively to the output terminal of the first latch and trigger unit 1 and the output terminal of the second latch and trigger unit 2.

The second latch and trigger unit 2 is configured to latch and output the source data signal from the first latch and trigger unit 1. The select unit 3 is configured to select and output the source data signal from the output terminal of the first latch and trigger unit 1 or the second latch and trigger unit 2.

The second latch and trigger unit 2 and the select unit 3 are configured to facilitate the first latch and trigger unit 1 to realize various driving methods to lengthen the input time of the first-row source data signal for the display of the first-row of pixels at the beginning of displaying each frame, allowing sufficient effective charging time for the first-row of pixels of the LCD panel after the polarity inversion of the source data signal, and improving the bad bright line or dark line display of the first-row of pixels appeared after the polarity inversion of the source data signal.

Further, the first latch and trigger unit 1 includes a first trigger module 11, a first latch module 12 and a second trigger module 13. The second latch and trigger unit 2 includes a second latch module 21 and a third trigger module 23. And the select unit 3 includes a select module 31.

The output terminal of the first trigger module 11 is connected to the input terminal of the first latch module 12. The output terminal of the first latch module 12 is connected to first input terminal of the second trigger module 13, and the first input terminal of the first trigger module 11 is configured to input the source data signal for display, line by line.

The output terminal of the second trigger module 13 is connected to the input terminal of the second latch module 21. And the output terminal of the second latch module 21 is connected to the first input terminal of the third trigger module 22.

The second input terminal of each of the first trigger module 11, the second trigger module 13, and the third trigger module 22 is configured respectively to input a same trigger control signal. The trigger control signal is configured to trigger respectively the first trigger module 11, the second trigger module 13, and the third trigger module 22, and to enable the output of the source data signal from the respective first input terminals of the first trigger module 11, the second trigger module 13, and the third trigger module 22 to the respective output terminals of the first trigger module 11, the second trigger module 13, and the third trigger module 22.

The first input terminal of the select module 31 is connected to the output terminal of the third trigger module 22. The second input terminal of the select module 31 is connected to the output terminal of the first latch module 12. The selection input terminal of the select module 31 is configured to input a selection trigger signal. The selection trigger signal is configured for the select module 31 to select and output the source data signal from the second input terminal of the select module 31.

Because the effective charging time for the display of a row of pixels is the overlap time between the required scanning time of the row of pixels and the time when the source data signal voltage is at a preset value P, the present disclosure provides various implementations to ensure the effective charging time of the first row of pixels is not less than the required scanning time of the first row of pixels.

In operation, various driving methods may be realized by the above-described driving circuit 804 to drive the display of the LCD panel frame by frame. According to the disclosed driving methods, the polarity of the source data signal is inverted at the beginning of displaying each frame, the timing of the source data signal and/or the timing of scanning the first row of pixels is configured in such a way that the time overlap between an actual scanning time of the first row and a time period when the source data signal is at or beyond a threshold value P to be no less than an original scanning time of the first row. In other words, the time from the beginning of the polarity inversion of the source data signal to the end of the scanning of first row of pixels of the LCD panel is greater than the original scanning time of the first row of pixels, which may be an average scanning time of a single-row of pixels in the n number of rows of pixels for one frame. This way, there is additional time for the source data signal to reach the preset threshold P before the first row of pixels is scanned. The amount of additional time may be set based on the timing of the source data signal. If the source data signal can reach the preset threshold P in shorter time, the less additional time may be needed. At the end of the display of a previous frame, the starting point of the polarity inversion of the source data signal is also a starting point of the display of a next frame.

By making the time from the beginning of the polarity inversion of the source data signal to the end of the scanning of the first-row of pixels of the LCD panel greater than the scanning time of a single-row of pixels, input time of the source data signal for the display of the first-row of pixels at the beginning of displaying each frame can be lengthened, so that the first-row of pixels may have sufficient effective charging time after the polarity inversion of the source data signal. Thus, the bright line or dark line display of the first-row of pixels at the end of polarity inversion of the source data signal can be prevented.

Figure 1:
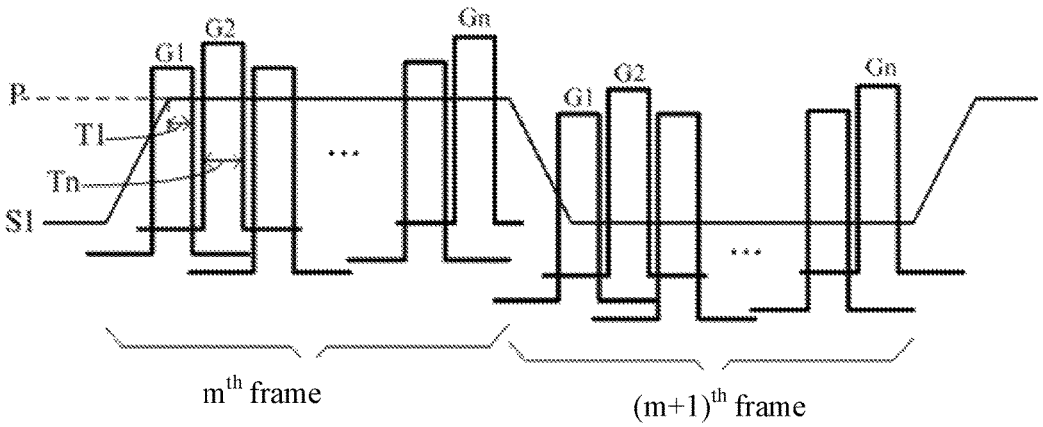
FIG. 1 (Prior art)
FIG. 1 illustrates a schematic timing sequence diagram at the beginning of displaying each frame of an existing driving method.
Figure 2:
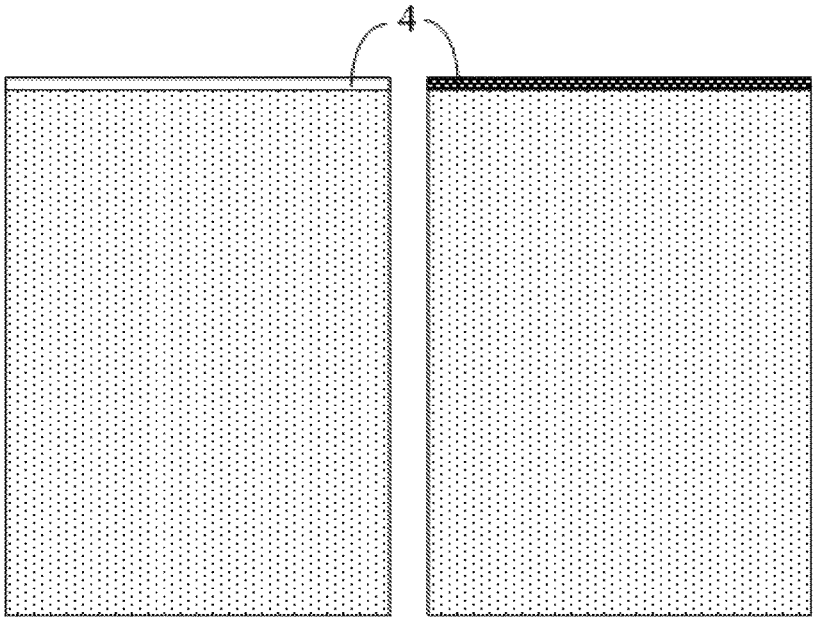
FIG. 2 (Prior art)
FIG. 2 illustrates a bad bright line and dark line display of the first-row of pixels of an LCD panel using existing driving methods.
Figure 3:
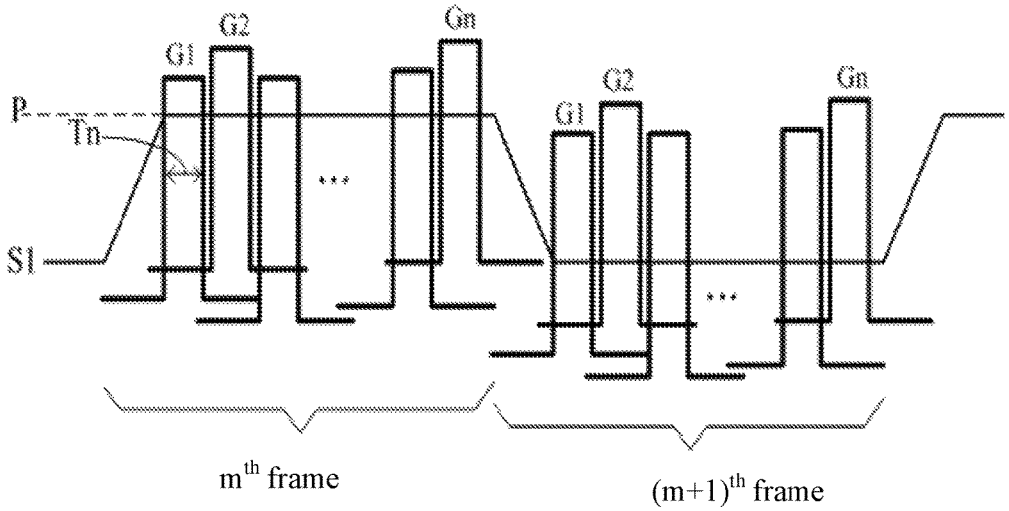
FIG. 3 illustrates a schematic timing sequence at the beginning of displaying each frame of an exemplary driving method according to the disclosed embodiments.

FIG. 3 illustrates a schematic timing sequence diagram of an exemplary driving method at the beginning of displaying each frame according to the disclosed embodiments. As shown in FIG. 3, the time from the beginning of the polarity inversion of the source data signal S1 to the end of the scanning of the first-row of pixels of the LCD panel is a sum of the single-row pixels scanning time Tn and the time from the beginning to the end of the polarity inversion of the source data signal.

That is, at the beginning of displaying each frame, the scanning of the first-row scan line G1 corresponding to the first-row of pixels is started right after the polarity inversion of the source data signal reaches a preset value P, i.e., a required desired voltage value of the source data signal during the display. That is, after the first-row source data signal S1 for the display of the first-row of pixels reaches the preset value P, the first row of pixels is scanned.

By such arrangements, it may be ensured that the first-row of pixels may start charging when the corresponding first-row source data signal S1 reaches the preset value P at the beginning of displaying each frame, which further ensures that, after the polarity inversion of the data signal, the effective charging time of the first-row of pixels equals to the scanning time of the single-row of pixels. Thus, the bad bright line or dark line display of the first-row of pixels appeared at the end of the polarity inversion of the source data signal can be prevented.

In addition, by setting the time from the beginning of the polarity inversion of the source data signal to the end of the scanning of the first-row of pixels of the LCD panel as the sum of the single-row of pixels scanning time Tn and the time from the beginning to the end of the polarity inversion of the source data signal reaching the preset value P, while avoiding the bad bright line or dark line display of the first-row of pixels, it also ensures that a lengthened input time of the first-row source data signal S1 takes a minimum amount of time during the display of each frame, which further ensures that each frame can be displayed in a sufficient time, i.e., the display of each frame will not be affected by the lengthened input time of the first-row source data signal S1. That is, the lengthening of the input time of the first-row source data signal S1 may be in a desired range so as to allow sufficient charging time for the first-row of pixels, but also to allow sufficient time to display the entire frame.

In the disclosed embodiments, the LCD panel may be displayed in a column inversion mode or a frame inversion mode. In the column inversion mode or frame inversion mode, the polarity of the source data signal for an entire frame needs to be inverted at the beginning of displaying each frame, which results in large panel load for the LCD panel at this moment. Thus, it may require a certain rise time and/or fall time for the source data signal to reach the preset value during the positive and negative polarity inversion, causing a shorter effective charging time for the first-row of pixels of each frame than the pixels of other rows after the polarity inversion of the source data signal. Therefore, the disclosed embodiments are more effective in solving the issues of bad bright line or dark line display of the first-row of pixels appeared in the display of the LCD panel in the column inversion or frame inversion mode.

Figure 4:
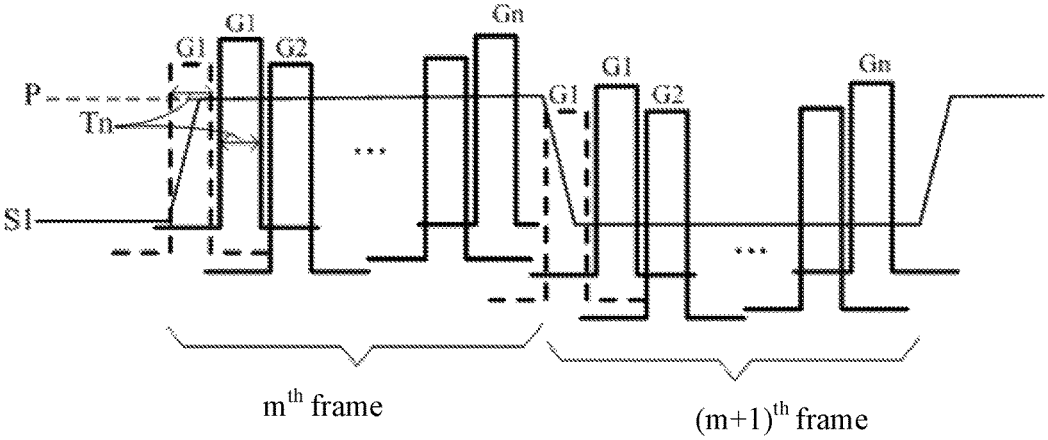
FIG. 4 illustrates a schematic timing sequence diagram at the beginning of displaying each frame of another exemplary driving method according to the disclosed embodiments.

FIG. 4 illustrates a schematic timing sequence diagram of another exemplary driving method at the beginning of displaying each frame according to the disclosed embodiments. As shown in FIG. 4, differing from the driving method illustrated in FIG. 3, the time from the beginning of polarity inversion of the source data signal to the end of the scanning of the first-row of pixels equals to twice of the scanning time of the single-row of pixels, i.e., 2 Tn. The first row of pixels are scanned twice within the time from the beginning of polarity inversion of the source data signal to the end of the scanning of the first-row of pixels, with the scanning time of each scanning equal to the scanning time Tn of the single-row of pixels.

According to the disclosed embodiments, at the beginning of displaying each frame, the time from the start to the end of the polarity inversion of the source data signal is generally shorter than the scanning time Tn of the single-row of pixels. Thus, when the first-row scan line G1 corresponding to the first-row of pixels is scanned at a first time, the first-row of pixels are charged for a period of time when the corresponding first-row source data signal S1 reaches the preset value P. This period of time equals to the single-row of pixels scanning time subtracting the time from the start to the end of the polarity inversion.

When the corresponding first-row scan line G1 of the first-row of pixels is scanned at a second time, the corresponding first-row source data signal S1 of the first-row of pixels has reached the preset value P. Thus, during the second scanning, the first-row of pixels are charged entirely at the preset value P of the first-row source data signal S1. That is, the effective charging time of the first-row of pixels is the single-row of pixels scanning time Tn during the second scanning.

After the twice scanning of the first-row of pixels, the charging time of the first-row of pixels is greater than the single-row of pixels scanning time. Thus, it may be ensured that the first-row of pixels have sufficient effective charging time, preventing the bad bright line or dark line display of the first-row of pixels at the beginning of displaying each frame.

It should be noted that, the time from the beginning of the polarity inversion of the source data signal to the end of the scanning of the first-row of pixels of the LCD panel may also be longer than twice of the scanning time of the single-row of pixels 2 Tn. However, the time from the beginning of the polarity inversion of the source data signal to the end of the scanning of the first-row of pixels of the LCD panel cannot be unlimited long. If the time is longer than a predetermined range, it may cause a reduced display time for the pixels of the entire frame from the second-row to the last-row, affecting the normal display of the entire frame.

Figure 5:
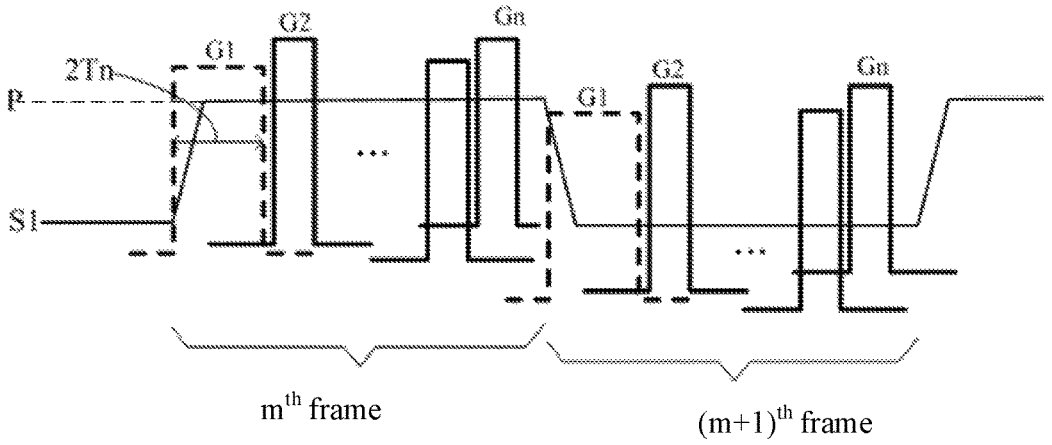
FIG. 5 illustrates a schematic timing sequence diagram at the beginning of displaying each frame of another exemplary driving method according to the disclosed embodiments.

FIG. 5 illustrates a schematic timing sequence diagram of another exemplary driving method at the beginning of displaying each frame according to the disclosed embodiments. As shown in FIG. 5, differing from the driving methods illustrated in FIGS. 3-4, the time from the beginning of the polarity inversion of the source data signal to the end of the scanning of the first-row of pixels of the LCD panel equals to twice of the scanning time of the single-row of pixels 2 Tn, and the first-row of pixels are scanned once during the time from the beginning of the polarity inversion of the source data signal to the end of the scanning of the first-row of pixels. The scanning time is twice of the scanning time of the single-row of pixels, i.e., 2 Tn.

At the beginning of displaying each frame, because the time from the start to the end of the polarity inversion is generally less than the single-row of pixels scanning time Tn, the corresponding first-row source data signal of the first-row of pixels has reached the preset value P in less than the single-row of pixels scanning time Tn. That is, in twice of the single-row of pixels scanning time 2 Tn, the time for the first-row of pixels to be effectively charged at the preset value P of the first-row source data signal S1 is greater than the single-row of pixels scanning time Tn and less than twice of the single-row of pixels scanning time 2 Tn.

Thus, it may be ensured that the first-row of pixels have sufficient effective charging time, preventing the bad bright line or dark line display of the first-row of pixels at the beginning of displaying each frame.

Figure 6:
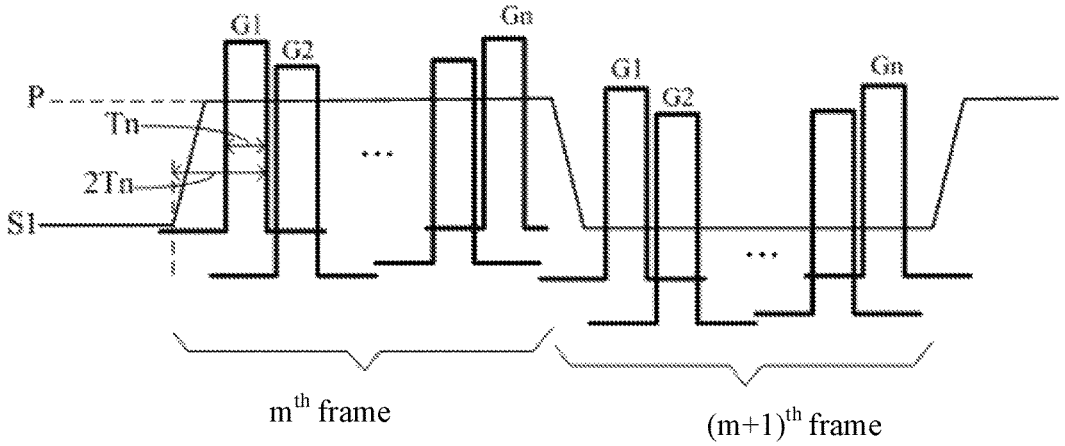
FIG. 6 illustrates a schematic timing sequence diagram at the beginning of displaying each frame of another exemplary driving method according to the disclosed embodiments.

FIG. 6 illustrates a schematic timing sequence diagram of an exemplary driving method at the beginning of displaying each frame according to the disclosed embodiments. As shown in FIG. 6, differing from the driving methods illustrated in FIGS. 3-5, the time from the beginning of the polarity inversion of the source data signal to the end of the scanning of the first-row of pixels of the LCD panel equals to twice of the single-row of pixels scanning time 2 Tn, the first-row of pixels are scanned once in the time from the beginning of the polarity inversion of the source data signal to the end of the scanning of the first-row of pixels, and the scanning time equals to the single-row of pixels scanning time Tn.

After the polarity inversion, the first-row source data signal S1 corresponding to the first-row of pixels reaches the preset value P, and the first-row source data signal S1 is kept at the preset value P before the corresponding first-row scan line G1 of the first-row of pixels is scanned.

Thus, when the first-row scan line G1 is scanned, the first-row of pixels are charged entirely at the preset value P of the first-row source data signal S1, i.e., the effective charging time of the first-row of pixels equals to the single-row of pixels scanning time Tn, same as other rows of pixels. Therefore, it may be ensured that the first-row of pixels have sufficient effective charging time, preventing the bad bright line or dark line display of the first-row of pixels appeared at the beginning of displaying each frame.

Thus, according to the disclosed driving methods as illustrated in FIGS. 3-6, by making the time from the beginning of the polarity inversion of the source data signal to the end of the scanning of first-row of pixels greater than the single-row of pixels scanning time, the input time of the first-row source data signal for the display of the first-row of pixels at the beginning of displaying each frame may be lengthened. Thus, the first-row of pixels of the LCD panel can have sufficient effective charging time after the polarity inversion of the source data signal, thereby improving the bad bright line or dark line display of the first-row of pixels appeared after the polarity inversion of the source data signal.

Returning to FIG. 7, to implement the various driving methods, the driving circuit 804 and/or the controller 802 may be configured accordingly to provide control signals, timing control, and source data signals. For illustrative purposes, details are provided with respect to the driving method where the time from the beginning of the polarity inversion of the source data signal to the end of the scanning of the first-row of pixels of the LCD panel equals to twice of the scanning time of a single-row of pixels.

At beginning, the display apparatus (e.g., the driving circuit, the controller, etc.) may obtain source data signals from any appropriate source for display on the LCD panel of the display apparatus. The source data signals (e.g., video signals) may include a plurality of frames for the LCD panel frame by frame. The LCD panel may contain a plurality rows of pixels for displaying the source data signals.

Further, the source data signal of one frame of the plurality of frames are inputted to the driving circuit and other related components. Because the LCD panel may operate in a column or frame inversion mode, the polarity of the source data signal of the one frame is inverted at beginning of displaying the one frame by scanning sequentially the plurality of rows of pixels.

Further, as illustrated in various driving methods, the time from the beginning of the polarity inversion of the source data signal to the end of scanning a first row of pixels is configured or controlled as being greater than a scanning time of a single row of pixels such that the first row of pixels has sufficient effective charging time. Further, the first row of pixels in the configured time is scanned and displayed, and the rest of the plurality of rows of pixels to display the one frame is also scanned and displayed.

During operation, as shown in FIG. 7, the trigger control signal is inputted when inputting each line of the source data signal. The trigger control signal includes a data line synchronization signal (i.e. the beginning of a line or row of pixels scanning) and a data-output enable signal. The selection trigger signal is inputted at the beginning of displaying each frame.

Specifically, at the beginning of displaying each frame, the first trigger control signal is triggered. The first-row source data signal corresponding to the first-row of pixels is inputted through the first input of the first trigger module 11 and stored in the first latch module 12.

When the second trigger control signal is triggered, the first-row source data signal is moved from the first latch module 12 to the second latch module 21 and stored in the second latch module 21. Meanwhile, a selection trigger signal is inputted to the selection input of the select module 31. The selection trigger signal triggers the select module 31 to output the first-row source data signal fed to its second input from the first latch module 12.

After level shifting, buffering, and D/A conversion, the first-row source data signal outputted from the select module 31 is outputted to the first-row of pixels of the LCD panel. At the same time, a second-row source data signal corresponding to the second-row of pixels is inputted through the first input of the first trigger module 11 and stored in the first latch module 12.

When the third trigger control signal is triggered, the first-row source data signal stored in the second latch module 21 is outputted to the first-row of pixels of the LCD panel. Meanwhile, the second-row source data signal is moved from the first latch module 12 to the second latch module 21 and stored in the second latch module 21, and a third-row source data signal corresponding to the third-row of pixels is inputted and stored in the first latch module 12.

When the fourth trigger control signal is triggered, the second-row source data signal stored in the second latch module 21 is outputted to the second-row of pixels of the LCD panel. Similarly, the rest of row source data signal can be outputted sequentially to the corresponding rows of pixels of the LCD panel.

At the beginning of displaying each frame, after the selection trigger signal triggers the select module 31 to select the output of the first-row source data signal stored in the first latch module 12, the selection trigger signal no longer triggers the select module 31 during the output of subsequent source data signal of each frame, so the row source data signal of each frame from the second row to the last row are all outputted through the second latch module 21 to each corresponding row of pixels of the LCD panel.

During the operation of the disclosed driving circuit, when the second trigger control signal and the third trigger control signal are triggered, it is the first-row source data signal outputted to the first-row of pixels of the LCD panel. Thus, it can be ensured that the first-row source data signal of each frame is kept twice of the scanning time of the single-row of pixels, i.e., lengthening the input time of the first-row source data signal of each frame.

In other words, the first-row source data signal of each frame is provided one-row in advance of each frame, and provided again as the first-row of each frame, i.e., the first-row source data signal of each frame is provided twice at the beginning of displaying each frame. Thus, the first-row source data signal can reach a preset value in advance, allowing the first-row of pixels to have sufficient effective charging time and preventing the bad bright line or dark line display of the first-row of pixels appeared at the beginning of displaying each frame.

It should be noted that, the disclosed driving circuit may also adjust the trigger control signal to be inputted at different time points to control the time from the beginning of the polarity inversion of the source data signal to the end of the scanning of the first-row of pixels of the LCD panel to be greater than the scanning time of the single-row of pixels and less than twice of the scanning time of the single-row of pixels.

Further, when the time from the beginning of the polarity inversion of the source data signal to the end of the scanning of the first-row of pixels is greater than twice of the scanning time of the single-row of pixels, it may need to increase the number of the latch and trigger units (i.e., the latch modules and the trigger modules). However, in general, increasing the time from the beginning of the polarity inversion of the source data signal to the end of the scanning of the first-row of pixels of the LCD panel to be less than or equal to twice of the scanning time of the single-row of pixels is sufficient to solve the bad bright line or dark line display of the first-row of pixels appeared at the beginning of displaying each frame. Therefore, it may be sufficient for the disclosed driving circuit to have two latch and trigger units (i.e. the first latch and trigger unit, and the second latch and trigger unit). Of course, more than two latch and trigger units may also be used.

According to the disclosed embodiments, the beneficial effects of the disclosed driving circuits include: the disclosed driving circuit is able to facilitate the first latch and trigger unit to realize any one of the driving methods illustrated in FIGS. 3-6 by adding the second latch and trigger unit and the select unit; the timing sequence of a source data signal and the gates are adjusted to allow the source data signal to start in advance for each frame by a single-row scanning time and to keep the first-row source data signal active for the duration of the first two rows. Thus, the input time of the first-row source data signal for the display of the first-row of pixels at the beginning of displaying each frame can be lengthened, which further ensures that the first-row of pixels of the LCD panel have sufficient effective charging time after the polarity inversion of the source data signal, improving the bad bright line or dark line display of the first-row of pixels appeared at the beginning of displaying each frame after the polarity inversion of the source data signal.

Thus, according to the disclosure, the driving method realizes a desired data timing or data timing sequence by adding a second latch and trigger unit and a select unit to facilitate a first latch and trigger unit. The timing sequence of the source data and the gates are adjusted to allow the source data to start in advance for each frame by a single-row scanning time and to keep the first-row source data active for the duration of the first two rows. Thus, an input time of the first-row source data signal for the display of the first-row of pixels at the beginning of displaying each frame can be lengthened. It may ensure that the first-row of pixels of the LCD panel have sufficient effective charging time after the polarity inversion of the source data signal, improving the bad bright line or dark line display of the first-row of pixels appeared at the beginning of displaying each frame after the polarity inversion of the source data signal.

The embodiments disclosed herein are exemplary only and not limiting the scope of this disclosure. Various alternations, modifications, or equivalents to the technical solutions of the disclosed embodiments can be obvious to those skilled in the art and can be included in this disclosure. Without departing from the spirit and scope of this invention, such other modifications, equivalents, or improvements to the disclosed embodiments are intended to be encompassed within the scope of the present disclosure.

What is claimed is:

1. A driving method of an LCD panel having rows of pixels, comprising:

obtaining source data signals of a plurality of frames for the LCD panel;

inputting a source data signal of one frame of the plurality of frames;

inverting polarity of the source data signal of the one frame before scanning sequentially the rows of pixels;

configuring at least one of starting timing of inverting the polarity of the source data signal and timing of scanning a first row of the rows of pixels to cause a time overlap between an actual scanning time of the first row and a time period when a potential of the source data signal reaches and remains at a threshold value to be equal to or greater than an original scanning time of the first row, wherein:

the original scanning time of the first row is an average scanning time of a single-row of pixels in the rows of pixels for the one frame, each row from a second row to a last row in the rows of pixels is scanned once for each frame, and the actual scanning time of the first row is equal to or greater than the average scanning time;

scanning the first row of the rows of pixels by the actual scanning time; and scanning rest of the rows of pixels to complete displaying the one frame, each row by the average scanning time.

2. The driving method according to claim 1, wherein configuring at least one of the starting timing of inverting the polarity of the source data signal and the timing of scanning the first row of the rows of pixels includes:

starting to scan the first row of the rows of pixels when the source data signal reaches the threshold value.

3. The driving method according to claim 1, wherein configuring at least one of the starting timing of inverting the polarity of the source data signal and the timing of scanning the first row of the rows of pixels includes:

starting to scan the first row of the rows of pixels after a time period of approximately the original scanning time of the first row from when the source data signal is inversed.

4. The driving method according to claim 1, wherein configuring at least one of the starting timing of inverting the polarity of the source data signal and the timing of scanning the first row of the rows of pixels and scanning the first row of the rows of pixels by the actual scanning time includes:

scanning the first row of the rows of pixels twice, each by the original scanning time, starting a first time of scanning of the first row of the rows of pixels from when the source data signal is inversed.

5. The driving method according to claim 4, wherein:

the source data signal reaches the threshold value during the first time scanning of the first row of the rows of pixels.

6. The driving method according to claim 1, wherein configuring at least one of the starting timing of inverting the polarity of the source data signal and the timing of scanning the first row of the rows of pixels and scanning the first row of the rows of pixels by the actual scanning time includes:

scanning the first row of the rows of pixels by twice of the original scanning time, starting from when the source data signal is inversed.

7. The driving method according to claim 1, wherein:

the LCD panel is displayed in one of a column inversion mode and a frame inversion mode.

8. A driving circuit, comprising:

a first latch and trigger circuit configured to latch and output a source data signal of frame line by line for a display of an LCD panel having a plurality of rows of pixels in response to a trigger control signal;

a second latch and trigger circuit configured to latch and output the source data signal from the first latch and trigger circuit in response to the trigger control signal; and a selector configured to selectively output one of output signals from the first latch and trigger circuit and the second latch and trigger circuit in response to a selection trigger signal, wherein:

at beginning of displaying each frame, the selection trigger signal is inputted to the selector to trigger the selector to output a first-row source data signal from the first latch and trigger circuit, and after the first-row source data signal is outputted, no selection trigger signal is inputted into the selector during an output of subsequent source data signals of each frame, and the selector outputs the subsequent source data signals from the second latch and trigger circuit so that, for each frame, a first row of the rows of the pixels includes a scanning time equal to or greater than a scanning time of another row that is different from the first row.

9. The driving circuit according to claim 8, wherein:

an input terminal of the second latch and trigger circuit is coupled to the output terminal of the first latch and trigger circuit; and input terminals of the selector are respectively coupled to the output terminal of the first latch and trigger circuit and the output terminal of the second latch and trigger circuit to select between the output signal of the first latch and trigger circuit and the output signal of the second latch and trigger circuit.

10. The driving circuit according to claim 9, wherein:

the first latch and trigger circuit further includes a first trigger circuit; and a first input terminal of the first trigger circuit is configured to input the source data signal for display line by line.

11. The driving circuit according to claim 10, wherein:

the first latch and trigger circuit further includes a first latch circuit and a second trigger circuit;

the second latch and trigger circuit further includes a second latch circuit and a third trigger circuit and an output terminal of the first trigger circuit is coupled to an input terminal of the first latch circuit, an output terminal of the first latch circuit is coupled to a first input terminal of the second trigger circuit, an output terminal of the second trigger circuit is coupled to an input terminal of the second latch circuit, and an output terminal of the second latch circuit is coupled to a first input terminal of the third trigger circuit.

12. The driving circuit according to claim 11, wherein:

a second input terminal of the first trigger circuit, a second input terminal of the second trigger circuit, and a second input terminal of the third trigger circuit are configured to input respectively the trigger control signal; and the trigger control signal is configured to trigger the first trigger circuit, the second trigger circuit and the third trigger circuit to output respectively the source signal from the respective first input terminals of the first trigger circuit, second trigger circuit and third trigger circuit.

13. The driving circuit according to claim 12, wherein:

the selector includes a select circuit;

a first input terminal of the select circuit is coupled to the output terminal of the third trigger circuit, and a second input terminal of the select circuit is coupled to the output terminal of the first latch circuit; and a select input of the select circuit is configured to input the selection trigger signal for the select circuit to select and output the source data signal from the second input of the select circuit.

14. The driving circuit according to claim 13, wherein:

the trigger control signal is inputted when each row source data signal is inputted; and the trigger control signal includes a data synchronization signal and a data output enable signal.

15. A display apparatus comprising the driving circuit according to claim 8.

* * * * *